US010071879B2

(12) United States Patent
Sorsa et al.

(10) Patent No.: US 10,071,879 B2
(45) Date of Patent: Sep. 11, 2018

(54) METHOD FOR CONTROLLING AN ELEVATOR SYSTEM

(71) Applicant: KONE CORPORATION, Helsinki (FI)

(72) Inventors: Janne Sorsa, Helsinki (FI); Juha-Matti Kuusinen, Helsinki (FI); Mirko Ruokokoski, Veikkola (FI)

(73) Assignee: KONE CORPORATION, Helsinki (FI)

( * ) Notice: Subject to any disclaimer, the term of this patent is extended or adjusted under 35 U.S.C. 154(b) by 686 days.

(21) Appl. No.: 14/634,173

(22) Filed: Feb. 27, 2015

(65) Prior Publication Data

US 2015/0166301 A1 Jun. 18, 2015

Related U.S. Application Data

(63) Continuation of application No. PCT/FI2013/050875, filed on Sep. 11, 2013.

(30) Foreign Application Priority Data

Sep. 11, 2012 (FI) ..... 20125942

(51) Int. Cl.
*B66B 1/16* (2006.01)
*B66B 1/24* (2006.01)

(52) U.S. Cl.
CPC ..... *B66B 1/2408* (2013.01); *B66B 1/2458* (2013.01); *B66B 2201/103* (2013.01); *B66B 2201/211* (2013.01); *B66B 2201/212* (2013.01); *B66B 2201/214* (2013.01); *B66B 2201/216* (2013.01); *B66B 2201/231* (2013.01)

(58) Field of Classification Search
CPC ..... B66B 2201/103; B66B 2201/211; B66B 2201/212; B66B 2201/214; B66B 2201/216; B66B 2201/231; B66B 1/2408; B66B 1/2458
USPC ..... 187/247, 380–388, 391, 393
See application file for complete search history.

(56) References Cited

U.S. PATENT DOCUMENTS 4,718,520 A * 1/1988 Schroder ..... B66B 1/2458 187/380
4,939,634 A * 7/1990 Schroder ..... B66B 1/2458 187/382
4,993,518 A * 2/1991 van Straaten ..... B66B 1/2458 187/387
5,932,852 A 8/1999 Tyni et al.
6,293,368 B1 * 9/2001 Ylinen ..... B66B 1/20 187/382

(Continued)

FOREIGN PATENT DOCUMENTS

CN 1181741 A 5/1998
CN 1688501 A 10/2005

(Continued)

*Primary Examiner* — Anthony Salata
(74) *Attorney, Agent, or Firm* — Birch, Stewart, Kolasch & Birch, LLP

(57) ABSTRACT

A method for controlling an elevator where an elevator is allocated for the use of a passenger in a first optimization phase in such a way that a first cost function is minimized, a second optimization phase is performed, in which the route of the allocated elevator is optimized in such a way that a second cost function is minimized.

20 Claims, 5 Drawing Sheets

(56) References Cited

U.S. PATENT DOCUMENTS

Figure 1A:
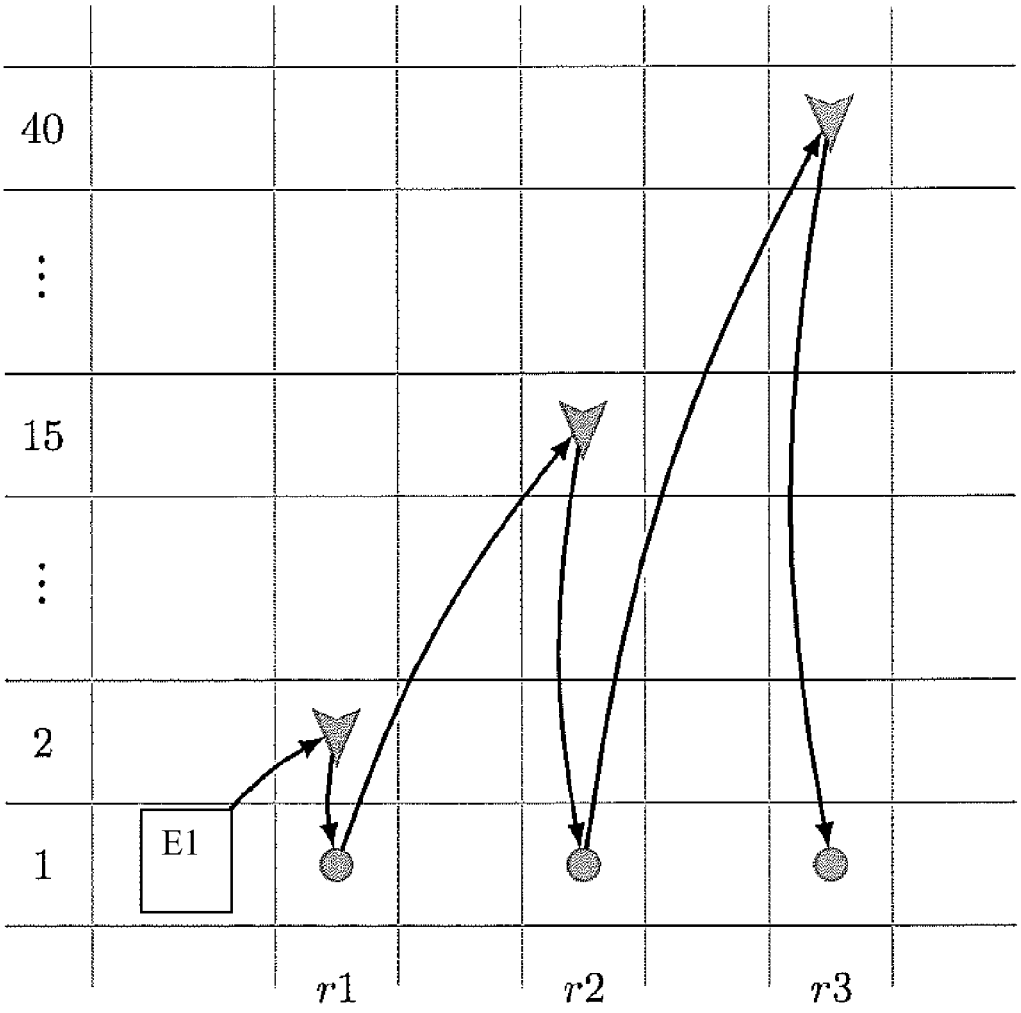

| | | | | |
|---|---|---|---|---|
| 6,345,697 | B1 * | 2/2002 | Siikonen | B66B 1/2458 187/247 |
| 6,644,442 | B1 * | 11/2003 | Ylinen | B66B 1/20 187/382 |
| 6,655,501 | B2 * | 12/2003 | Kostka | B66B 1/2458 187/247 |
| 6,935,467 | B1 * | 8/2005 | Tyni | B66B 1/20 187/247 |
| 7,546,906 | B2 * | 6/2009 | Tyni | B66B 1/2458 187/247 |
| 7,694,781 | B2 * | 4/2010 | Sorsa | B66B 1/2458 187/382 |
| 7,900,750 | B2 * | 3/2011 | Mattsson | B66B 1/2458 187/247 |
| 7,909,143 | B2 * | 3/2011 | Tyni | B66B 1/2458 187/247 |
| 9,580,271 | B2 * | 2/2017 | Sorsa | B66B 1/2408 |
| 2005/0217946 | A1 | 10/2005 | Siikonen et al. | |
| 2008/0105499 | A1 | 5/2008 | Tyni et al. | |
| 2008/0296099 | A1 | 12/2008 | Tyni et al. | |

FOREIGN PATENT DOCUMENTS

| | | | |
|---|---|---|---|
| CN | 101171195 | A | 4/2008 |
| CN | 101389559 | A | 3/2009 |
| EP | 0 565 864 | A1 | 10/1993 |
| FI | 112856 | B | 1/2004 |
| JP | 2008-214099 | A | 9/2008 |
| WO | WO 99/21787 | A1 | 5/1999 |
| WO | WO 01/65231 | A2 | 9/2001 |
| WO | WO 2005/042389 | A1 | 5/2005 |
| WO | WO 2005/100223 | A2 | 10/2005 |
| WO | WO 2006/120283 | A1 | 11/2006 |
| WO | WO 2009/068725 | A1 | 6/2009 |

* cited by examiner

METHOD FOR CONTROLLING AN ELEVATOR SYSTEM

CROSS REFERENCE TO RELATED APPLICATIONS

This application is a Continuation of PCT International Application No. PCT/F12013/050875, filed on Sep. 11, 2013, which claims priority under 35 U.S.C. 119(a) to Patent Application No. 20125942, filed in Finland on Sep. 11, 2012, all of which are hereby expressly incorporated by reference into the present application.

The present invention relates to the routing of elevators. More particularly the invention relates to the optimal control of elevators with a route selection for serving the calls given by passengers.

BACKGROUND OF THE INVENTION

The allocation to elevators of calls given by elevator users is one of the basic tasks of the control of the elevator system. The objective of allocation is to give calls to the elevators to serve in such a way that some desired performance indicator or performance indicator plurality describing the operation of the elevator system would be as good as possible. Commonly used performance indicators are e.g. performance indicators relating to the waiting times of passengers and to energy consumption. In conventional elevator systems a passenger indicates with the up/down pushbuttons that are in the elevator lobby his/her travel direction, and after the elevator car has arrived at the call-giving floor, the passenger moves into the elevator car and in the elevator car gives a so-called car call to the floor to which he/she is going. The call-giving method described above makes it possible that the elevator car serving the call does not need to be decided immediately at the moment the call is given, but instead the control system can repeat the allocation calculation and later decide the elevator car serving the call. In skyscrapers and in other high-rise buildings a so-called destination call system is used to a constantly increasing extent. In a destination call system a passenger gives a destination call to his/her destination floor already with the call-giving device in the elevator lobby, in which case he/she does not need to give a separate car call in the elevator car. Differing from a conventional call-giving system, the elevator car serving a destination call is generally decided immediately when the destination call has been registered.

In elevator technology numerous different calculation methods have been applied for solving an allocation task. Each method, of course, involves a plurality of characteristic parameters that have the purpose of affecting the functioning of the method. In the method e.g. the most suitable parameter plurality can be taken into use in different traffic situations. This is to give the elevator system the opportunity to adapt its operation to be the most suitable with respect to the prevailing traffic situation. The virtue of different allocation options can be compared with a so-called cost function, the aim being to find the minimum value of the cost function and thus to achieve the desired service objectives.

One effective prior-art allocation method for elevators is the use of genetic algorithms especially in systems comprising a number of elevators. The use of genetic algorithms is described in e.g. Finnish patent publication FI112856B.

In the allocation methods known in the art the elevator serving a call is decided but the service sequence (routing) of the calls allocated to elevators is not optimized, but instead so-called collective control is used as the service sequence. In collective control each elevator serves calls in sequence in its run direction. One problem with collective control, however, is that it does not always result in an optimal solution for achieving the desired service objectives in the elevator system.

AIM OF THE INVENTION

The aim of the present invention is to eliminate or at least to alleviate the aforementioned drawbacks that occur in solutions according to prior-art. The aim of the invention is also to achieve one or more of the following objectives:

- to enable the continuous optimization of the routings of elevators and the correction of them also after the call-giving, and
- to enable more versatile optimization criteria than before for allocating calls.

SUMMARY OF THE INVENTION

Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The present invention discloses a method for optimally controlling an elevator system. The elevator system comprises at least one elevator, call-giving devices for giving calls to the elevator system, and also a control system that responds to the calls. In the method a call given by a passenger is registered, an elevator serving the call is allocated in a first optimization phase in such a way that a desired first cost function is minimized, the route of the allocated elevator is optimized in a second optimization phase in such a way that a desired second cost function is minimized, and the allocated elevator is controlled according to the optimized route. A cost function means a calculation model describing the virtue of some service objective or of a combination of them. A cost function contains at least one so-called cost term. A cost term is composed of a magnitude that is of interest from the viewpoint of the operation of elevators, and its weighting coefficient. For example, the call times, waiting times, travel times, run times and/or energy consumption related to the service of the call can be used as these magnitudes.

The cost function of the first optimization phase and of the second optimization phase can be the same or it can be a different cost function depending on the desired service objectives. Calls, in this context, mean both external calls given with conventional up/down call pushbuttons and destination calls given with destination call panels. In the first optimization phase and/or in the second optimization phase e.g. genetic algorithms can be used as an optimization method. In one embodiment of the invention in the first optimization phase the collective control principle is used.

In one embodiment of the invention the optimized route of an elevator is updated at least once by repeating the second optimization phase during the elevator service. Elevator service means that an elevator has one or more calls being served. As a result of the embodiment, the routing of the elevator can be changed if new destination calls, up/down calls and/or car calls are given to the elevator, or other changes occur, during the elevator service, from the effect of which some other route option is more optimal than the original route option.

In one embodiment of the invention the cost function is minimized for at least one desired magnitude or cost term with a set boundary condition. For example, an upper limit can be set for the average waiting time so that passengers will not have to wait for an elevator for an unreasonably long time.

In one embodiment of the invention the control system makes an assumption about the destination floor of the passenger in such a way that when pressing the up call pushbutton the topmost floor that the elevator system serves is used as the default floor. Correspondingly, when pressing the down call button, the bottommost floor that the elevator system serves is used as the default floor.

With the method according to the invention the service capability of an elevator system can be improved by performing the allocation and routing of the elevators in two optimization phases. The fact that a selected route can be updated/modified during the elevator service can also improve service capability. By using different optimization objectives in different optimization phases, more precise optimization than before is reached in the control of elevators. On the whole the method according to the invention enables a more versatile optimization of the control of an elevator system compared to the control methods known in the art.

LIST OF FIGURES

Figure 1B:
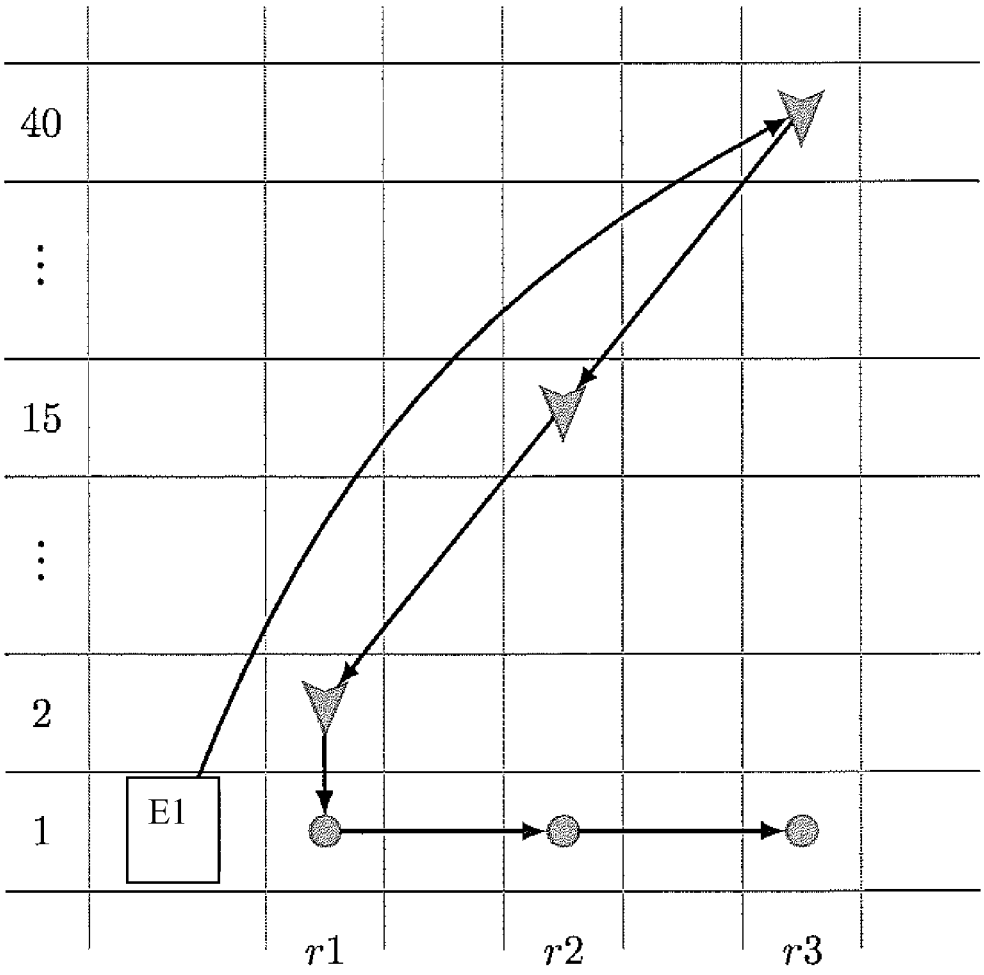
Figure 2A:
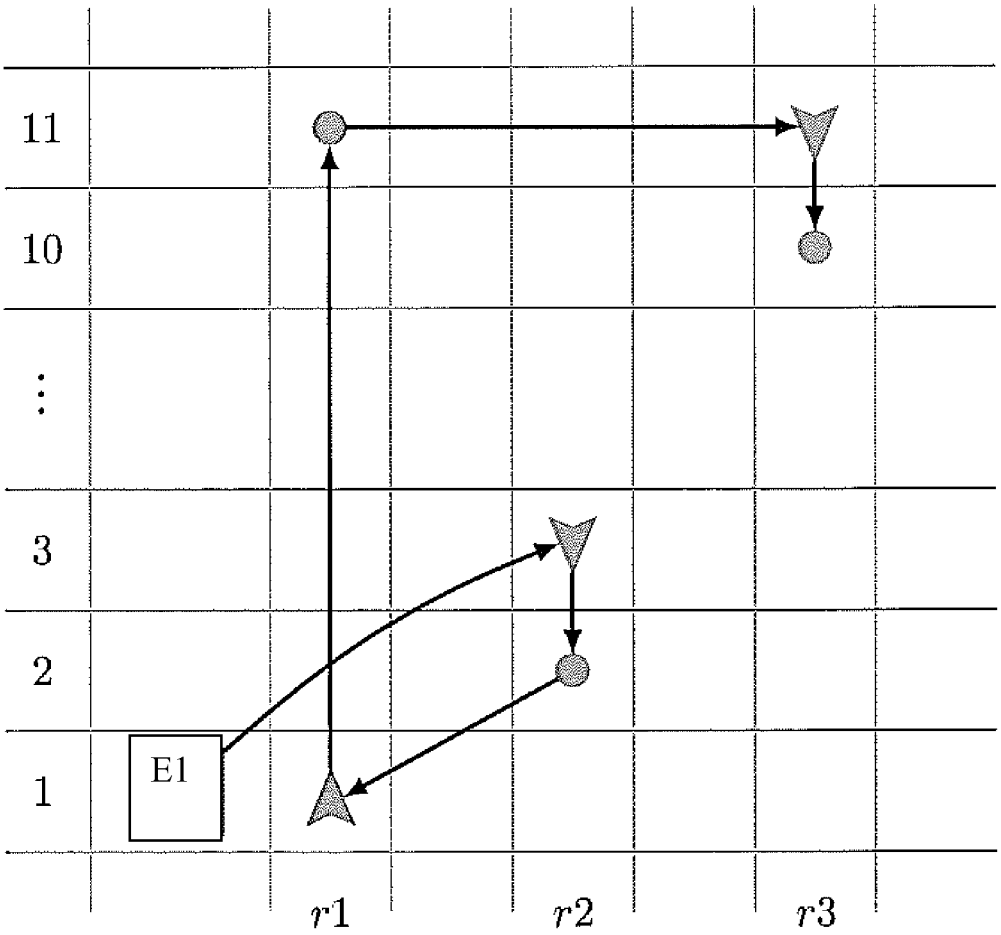
Figure 2B:
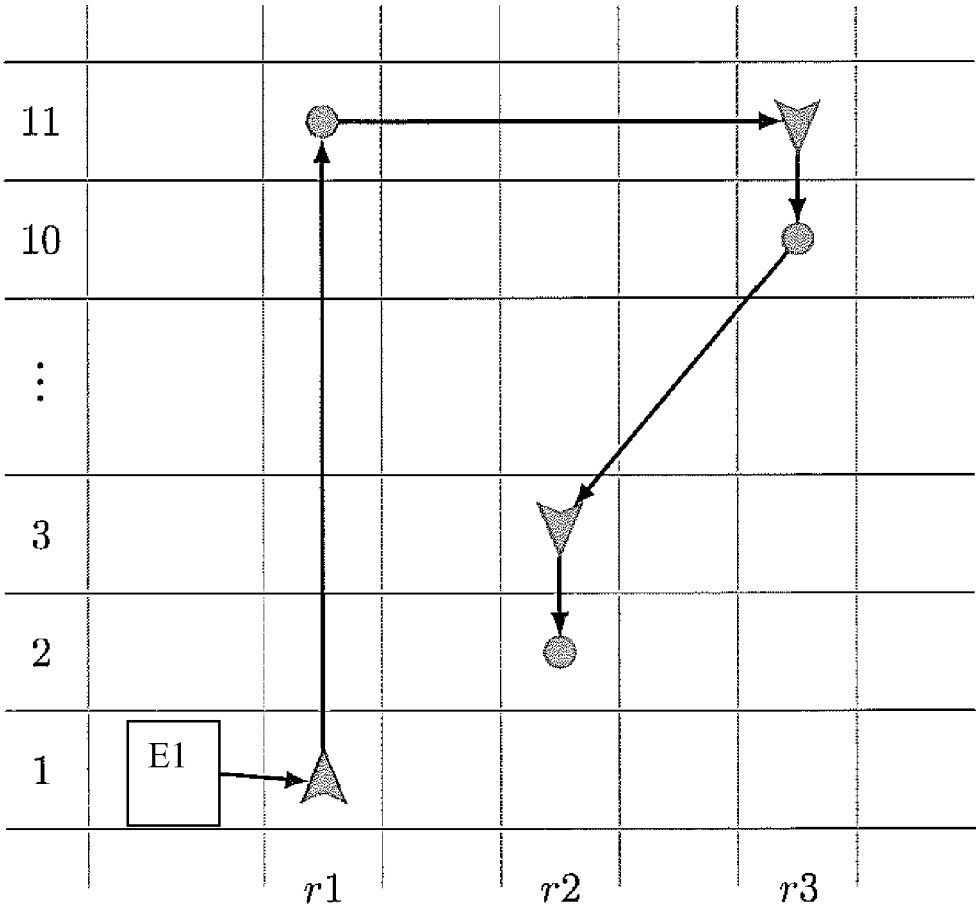
Figure 3:
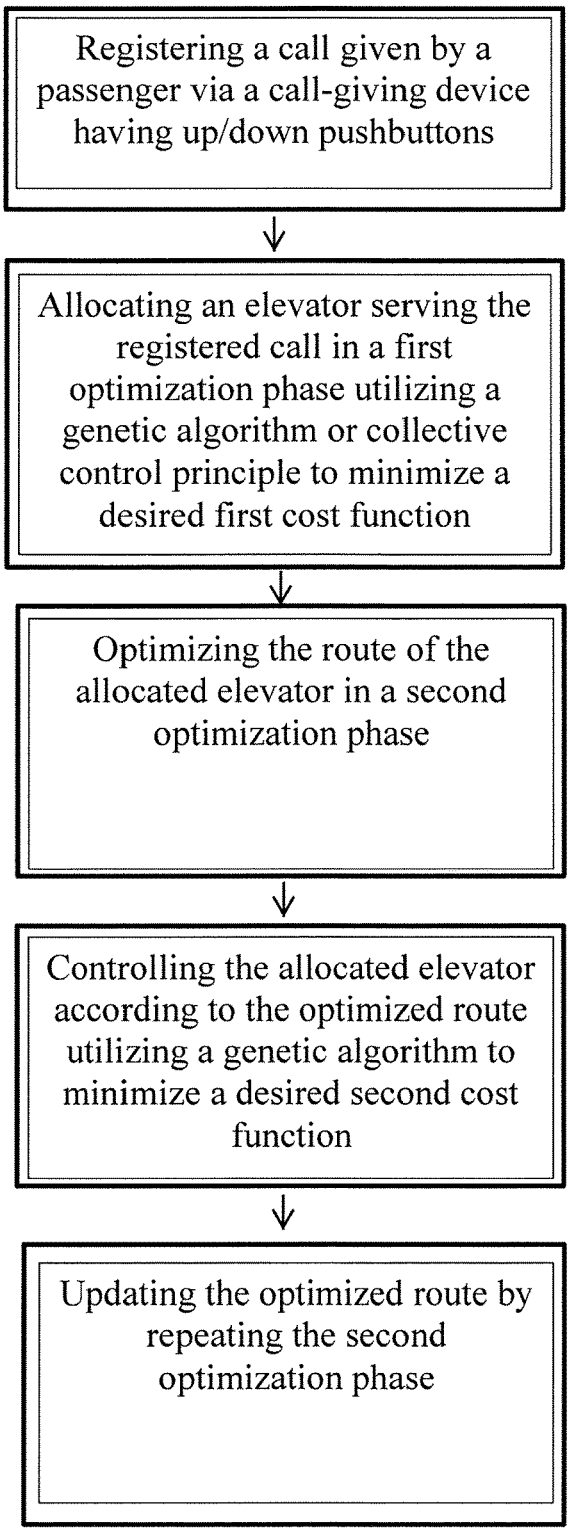

FIG. 1*a* presents the routing, produced by the method according to the invention, for an elevator in one embodiment, FIG. 1*b* presents the routing, produced by collective control, for an elevator in the embodiment according to FIG. 1*a*, FIG. 2*a* presents the routing, produced by the method according to the invention, for an elevator in a second embodiment, FIG. 2*b* presents the routing, produced by collective control, for an elevator in the embodiment according to FIG. 2*a*, and FIG. 3 presents a method for optimizing an elevator system.

DETAILED DESCRIPTION OF THE INVENTION

In the following the invention will be described in the light of some embodiments.

Embodiment 1. The elevator system of a building comprises one elevator E1, which is at floor F1. Three passengers have given to the elevator system destination calls r1, r2 and r3 according to Table 1:

TABLE 1

| Call | Departure floor | Destination floor |
|---|---|---|
| r1 | 2 | 1 |
| r2 | 15 | 1 |
| r3 | 40 | 1 |

The following table presents the parameters connected to the elevator E1.

TABLE 2

| Parameter | Value |
|---|---|
| Rated speed of elevator car | 4 m/s |
| Acceleration of elevator car | 1 m/s**2 |
| Jerk | 1.6 m/**3 |
| Capacity | 13 persons |
| Door opening time | 3 s |
| Door closing time | 3.1 s |
| Person transfers (in, out) | 2 s |

The following table presents the parameters connected to the building.

TABLE 3

| Parameter | Value |
|---|---|
| Number of floors | 40 floors |
| Floor-to-floor height | 3.3 m |

Table 4 presents the waiting times and travel times connected to the optimal routing calculated according to the invention.

TABLE 4

| Magnitude | r1 | r2 | r3 | Average |
|---|---|---|---|---|
| Waiting time (s) | 10.41 | 45.10 | 112.27 | 55.93 |
| Travel time (s) | 21.82 | 68.37 | 156.17 | 88.12 |

Table 5 presents the waiting times and travel times achievable with routing based on conventional collective control.

TABLE 5

| Magnitude | r1 | r2 | r3 | Average |
|---|---|---|---|---|
| Waiting time (s) | 97.70 | 75.25 | 42.90 | 71.95 |
| Travel time (s) | 109.11 | 110.11 | 111.11 | 110.11 |

FIG. 1*a* presents a route according to Embodiment 1, which route is optimized with the method according to the invention, for an elevator E1.

FIG. 1*b* presents a route according to Embodiment 1, which route is based on collective control.

Embodiment 2: In this embodiment the energy consumption is examined instead of waiting times and travel times. In the same way as Embodiment 1, in this embodiment the elevator system of the building comprises one elevator E1 and three passengers have given destination calls r1, r2 and r3 according to Table 6.

TABLE 6

| Call | Departure floor | Destination floor |
|---|---|---|
| r1 | 1 | 11 |
| r2 | 3 | 2 |
| r3 | 11 | 10 |

The following table 7 presents the parameters connected to the elevator E1.

TABLE 7

| Parameter | Value |
|---|---|
| Rated speed of elevator car | 4 m/s |
| Acceleration of elevator car | 1 m/s**2 |
| Jerk | 1.6 m/**3 |
| Capacity | 1800 kg |

When the route of the elevator is optimized with the method according to the invention, an energy consumption of 102 Wh is obtained and correspondingly 293 Wh with routing based on conventional collective control, the difference being 187%. (In the calculation the values of Table 3 have been used as the parameters of the building).

FIG. 2*a* presents an optimized route of the elevator E1 according to Embodiment 2, and FIG. 2*b* a route based on the collective control according to Embodiment 2.

FIG. 3 presents a method for controlling an elevator system, including registering a call given by a passenger via a call-giving device having up/down pushbuttons, allocating an elevator serving the registered call in a first optimization phase utilizing a genetic or collective control principle to minimize a desired first cost function, optimizing the route of the allocated elevator in a second optimization phase, controlling the allocated elevator according to the optimized route utilizing a genetic algorithm to minimize a desired second cost function and updating the optimized route by repeating the second optimization phase.

The method according to the invention is also applicable to elevator systems in which up/down call-giving pushbuttons are used for calling an elevator to a floor. According to one embodiment of the invention the control system makes an assumption about the destination floor e.g. in such a way that when pressing the up call pushbutton the topmost floor that the elevator system serves is used as the default floor. Correspondingly, when pressing the down call button, the bottommost floor that the elevator system serves is used as the default floor. It is also possible to collect statistical data about the elevator journeys made by passengers and to use the data in question to advantage in the definition of the default floor.

In both the first optimization phase and the second optimization phase genetic algorithms can be utilized. When a new call has been allocated to an elevator, and the optimal route calculated in the manner described above, the route can be updated by repeatedly performing a second optimization phase during the elevator service. A limit value, which may not be overshot/undershot in the optimization, can be set for the desired magnitude or cost term in the cost function of the first and/or second optimization phase. With this it can be ensured that e.g. the waiting times of passengers do not exceed the set limit value. In the first optimization phase preferably the collective control principle is used, with the cost terms being call times, waiting times, travel times, run times and/or energy consumptions. In the second optimization phase the route of the elevator is optimized by minimizing some certain cost term, e.g. the energy consumption of the elevator for serving the calls. Since the route of the elevator has not necessarily after this been implemented as a route according to collective control, this can cause in elevator passengers doubtfulness and uncertainty about the routes used by the elevators. To avoid this, the elevator lobbies and/or elevator cars can be provided with information means for informing elevator passengers of the routes used by the elevators.

The invention is not only limited to be applied to the embodiments described above, but instead many variations are possible within the scope of the inventive concept defined by the claims. Thus, for example, route optimization can be performed for one or more elevators before or after the making of the final allocation decision.

The invention claimed is:

1. A method for controlling an elevator system, which elevator system comprises: at least one elevator; call-giving devices for giving calls to the elevator system; and a control system that is responsive to the calls, wherein the method comprises the steps of:

registering a call given by a passenger;

allocating an elevator serving the registered call in a first optimization phase in such a way that a desired first cost function is minimized;

optimizing the route of the allocated elevator in a second optimization phase in such a way that a desired second cost function is minimized; and controlling the allocated elevator according to the optimized route.

2. The method according to claim 1, further comprising the step of updating the optimized route of an elevator by repeating the second optimization phase during the elevator service.

3. The method according to claim 1, further comprising the step of utilizing genetic algorithms in the first and/or in the second optimization phase.

4. The method according to claim 1, further comprising the step of using the collective control principle in the first optimization phase.

5. The method according to claim 1, wherein the first cost function and/or the second cost function comprises at least one magnitude related to the operation of the elevator system, which magnitudes are: call time, waiting time, travel time, run time, traffic intensity, and energy consumption.

6. The method according to claim 1, wherein the first cost function and/or the second cost function is minimized for at least one desired magnitude with a set boundary condition.

7. The method according to claim 1, wherein the method further comprises the phase: further comprising the step of making an assumption about the destination floor of a passenger if the call is given with up/down call pushbuttons.

8. The method according to claim 2, further comprising the step of utilizing genetic algorithms in the first and/or in the second optimization phase.

9. The method according to claim 2, further comprising the step of using the collective control principle in the first optimization phase.

10. The method according to claim 3, further comprising the step of using the collective control principle in the first optimization phase.

11. The method according to claim 2, wherein the first cost function and/or the second cost function comprises at least one magnitude related to the operation of the elevator system, which magnitudes are: call time, waiting time, travel time, run time, and traffic intensity, energy consumption.

12. The method according to claim 3, wherein the first cost function and/or the second cost function comprises at least one magnitude related to the operation of the elevator system, which magnitudes are: call time, waiting time, travel time, run time, and traffic intensity, energy consumption.

13. The method according to claim 4, wherein the first cost function and/or the second cost function comprises at least one magnitude related to the operation of the elevator system, which magnitudes are: call time, waiting time, travel time, run time, and traffic intensity, energy consumption.

14. The method according to claim 2, wherein the first cost function and/or the second cost function is minimized for at least one desired magnitude with a set boundary condition.

15. The method according to claim 3, wherein the first cost function and/or the second cost function is minimized for at least one desired magnitude with a set boundary condition.

16. The method according to claim 4, wherein the first cost function and/or the second cost function is minimized for at least one desired magnitude with a set boundary condition.

17. The method according to claim 5, wherein the first cost function and/or the second cost function is minimized for at least one desired magnitude with a set boundary condition.

18. The method according to claim 2, further comprising the step of making an assumption about the destination floor of a passenger if the call is given with up/down call pushbuttons.

19. The method according to claim 3, further comprising the step of making an assumption about the destination floor of a passenger if the call is given with up/down call pushbuttons.

20. The method according to claim 4, further comprising the step of making an assumption about the destination floor of a passenger if the call is given with up/down call pushbuttons.

* * * * *